US012729467B2

(12) United States Patent
Bergfeld et al.

(10) Patent No.: US 12,729,467 B2
(45) Date of Patent: Sep. 8, 2026

(54) USE OF LYOCELL FIBERS

(71) Applicant: LENZING AKTIENGESELLSCHAFT, Lenzing (AT)

(72) Inventors: Michael Bergfeld, Tiefgraben (AT); Peter Andrew Slater, Nuneaton (GB); Oliver Woodrow, Lenzing (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 639 days.

(21) Appl. No.: 18/006,910

(22) PCT Filed: Jul. 28, 2021

(86) PCT No.: PCT/EP2021/071091
§ 371 (c)(1),
(2) Date: Jan. 26, 2023

(87) PCT Pub. No.: WO2022/023394
PCT Pub. Date: Feb. 3, 2022

(65) Prior Publication Data

US 2023/0265587 A1 Aug. 24, 2023

(30) Foreign Application Priority Data

Jul. 29, 2020 (EP) ..... 20188361

(51) Int. Cl.
*D04H 1/4391* (2012.01)
*D04H 1/498* (2012.01)
*D04H 1/732* (2012.01)

(52) U.S. Cl.
CPC ..... *D04H 1/43912* (2020.05); *D04H 1/498* (2013.01); *D04H 1/732* (2013.01)

(58) Field of Classification Search
CPC .... D04H 1/28; D04H 1/4258; D04H 1/43912; D04H 1/498; D04H 1/732; D21H 13/08;
(Continued)

(56) References Cited

U.S. PATENT DOCUMENTS 3,318,990 A 5/1967 Kajitani
5,158,844 A 10/1992 Hagens et al.
(Continued)

FOREIGN PATENT DOCUMENTS

DE 198 55 644 A1 6/1999
EP 0 572 921 A1 12/1993
(Continued)

*Primary Examiner* — Lynda Salvatore
(74) *Attorney, Agent, or Firm* — Venable LLP

(57) ABSTRACT

The invention relates to the use of a lyocell fiber (1) for the manufacture of a nonwoven fiber fleece (10, 100). To manufacture a thin nonwoven fiber fleece with sufficient mechanical properties, the use of a lyocell fiber is proposed, where the fiber (1) has a cross-sectional aspect ratio of at least 1.8.

The invention further relates to a nonwoven fiber fleece (10, 100). In order to manufacture a thin nonwoven fiber fleece (10, 100) suitable for use as a battery separator, it is proposed, that the fiber fleece comprises at least two layers (11, 12) of fibrillated lyocell fibers (13), with the fibrillated lyocell fibers (13) having solid cores (14, 110) and fibrils (15) protruding from said cores (14), the fibers and fibrils (15) being intermingled to form the fiber fleece (10), embedding the solid cores (14) therein, whereby the solid cores (14, 110) of the fibrillated lyocell fibers (13) have an average cross-sectional aspect ratio k of at least 1.5.

13 Claims, 5 Drawing Sheets

(58) Field of Classification Search
CPC ... D21H 13/10; D21H 13/36; H01M 50/4295; H01M 50/44; Y02E 60/10
IPC ..... D04H 1/4391,1/498, 1/732, 1/28, 1/4258; D21H 13/08, 13/10, 13/36; H01M 50/414, 50/429, 50/44
See application file for complete search history.

(56) References Cited

U.S. PATENT DOCUMENTS

| | | | |
|---|---|---|---|
| 5,366,832 | A | 11/1994 | Hayashi et al. |
| 5,700,700 | A | 12/1997 | Hwang |
| 5,942,354 | A | 8/1999 | Oxley et al. |
| 6,258,488 | B1 | 7/2001 | Askew et al. |
| 7,386,868 | B2 | 6/2008 | McCormack |
| 8,097,366 | B2 | 1/2012 | Harada et al. |
| 8,865,336 | B2 | 10/2014 | Hayakawa et al. |
| 2007/0014080 | A1 | 1/2007 | McCormack |
| 2009/0017385 | A1 | 1/2009 | Harada et al. |
| 2010/0021711 | A1 | 1/2010 | Schrempf et al. |
| 2010/0310921 | A1 | 12/2010 | Hayakawa et al. |
| 2015/0093650 | A1 | 4/2015 | Gallo et al. |
| 2015/0380703 | A1 | 12/2015 | Gallo et al. |
| 2020/0054975 | A1* | 2/2020 | Belmont ..... D21H 11/18 |

FOREIGN PATENT DOCUMENTS

| | | | | |
|---|---|---|---|---|
| EP | 3 385 428 | A1 | 10/2018 | |
| JP | H09-241968 | A | 9/1997 | |
| JP | 2000-030687 | A | 1/2000 | |
| JP | 2005183161 | A * | 7/2005 | ..... Y02E 60/10 |
| WO | 97/37392 | A1 | 10/1997 | |
| WO | 2007/143761 | A1 | 12/2007 | |
| WO | 2010/071906 | A1 | 7/2010 | |
| WO | 2013/159948 | A1 | 10/2013 | |
| WO | 2014/127828 | A1 | 8/2014 | |

* cited by examiner

USE OF LYOCELL FIBERS

CROSS REFERENCE TO RELATED APPLICATIONS

The present application is a national-stage entry under 35 U.S.C. § 371 of International Patent Application No. PCT/EP2021/071091, published as WO 2022/023394 A1, filed Jul. 28, 2021, which claims priority to EP 20188361.8, filed Jul. 29, 2020, the entire disclosure of each of which is hereby incorporated by reference.

BACKGROUND OF THE INVENTION

Field of the Invention

The present invention relates to the use of lyocell fibers in a non-woven fiber fleece. Especially, the present invention relates to the use of certain specific lyocell fibers in the manufacture of papers for purposes such as a filtration paper or, in particular, a paper to be used in a battery separator.

Prior Art

Batteries, including alkaline (primary and secondary) and lithium-ion batteries, include separators comprising a porous layer that may include polymeric fibers. Polymeric film separators are most commonly used, however, separators made from non-polymeric inorganic fibers have also been employed. Such separators serve to prevent an electrical connection between the anode and the cathode of the battery, or a short circuit.

Cellulosic fibers are widely employed in battery separator papers due to their ability to absorb and retain the electrolytes. However, some of these cellulosic fibers (like rayon or mercerized pulp) have a poor fibrillation ability and, therefore, do not allow obtaining battery separators with the desired properties in terms of density, porosity and dimensional stability.

Cellulosic fibers of the lyocell genus are well known for their fibrillation ability and are employed in battery separators. Lyocell fibers are spun from a solution of cellulose in a tertiary amine-oxide.

Thanks to the fine and long fibrils, the separators made with such fibrillated lyocell fibers have a suitable porosity, the ion mobility inside the battery is very good and the efficiency of the battery is high. The fibrils interlace very well during paper making and form a dense structure with low shrinkage and high dimensional stability. Moreover, the average size of the pores is small, and this represents a barrier for dendrites.

The use of lyocell fibers in battery separators has been disclosed in EP 0 572 921 A1, US 2007/0014080 A1, US 2010/0310921 and US 2009/0017385 A1. WO 97/37392 discloses a battery separator made from a cellulose film formed from a solution of cellulose in an amine oxide. Further state of the art is provided by U.S. Pat. No. 5,700,700 and DE 198 55 644.

WO 2013/159948 and WO 2014/127828 A1 disclose the use of lyocell fibers with specific properties in a battery separator.

U.S. Pat. No. 3,318,990 discloses the use of viscose hollow flat fibers in lustrous and transparent papers. The viscose fibers need to be modified with water-swellable polymers in order to make them suitable for this purpose.

In order to achieve the most favorable performance, cellulosic fibers used in papers, especially papers for filtration purposes and battery separator papers, require to be fibrillated prior to the sheet making process. This, so-called refining process, is a very time and energy intensive process. In addition to fibrillation, refining of cellulosic fibers to a high degree of freeness has a detrimental effect of reducing the average length of the fibers being refined. The consequences thereof are lower mechanical properties of the resulting separator sheet.

The fibrillation of lyocell fibers occurs at the surface regions of the fibers. This means that even when lyocell fibers are fibrillated to high freeness levels, central regions of the fibers remain unfibrillated, forming a residual core from each of the individual fibers.

A sheet is formed when at least two (2) layers of fibrillated fibers overlap. This means that the minimum thickness of the sheet is proportional to the thickness of the fibrillated fibers that build it.

A standard lyocell fiber has an essentially round cross section, whereby a round cross section lyocell fiber with a titer of 1.7 dtex has a diameter of approx. 12 μm in the dry state. After extensive fibrillation, the residual core diameter is on average 10 μm. Lyocell fibers with reduced diameter may be produced by making suitable adjustments to the fiber spinning conditions. The lyocell fibers may also be fibrillated by refining to high degrees of freeness, e.g., 80° SR (degree Schopper Riegler). The residual core diameter of the fibers after refining is approximately 2 μm smaller than the original diameter of the initial lyocell fibers. The smallest hitherto fiber diameter achieved in small scale spinning trials was approximately 8 μm and the resulting residual core diameter achieved after refining these 8 μm diameter fibers was approximately 6 μm. Producing smaller titers (and therefore smaller residual core diameters) is technically and economically challenging.

DISCLOSURE OF THE INVENTION

There is still a desire for non-woven fleeces, especially papers, having sufficient strength even at a very low thickness.

The present invention sets out as its task to provide such improved non-woven fleeces.

This task is solved by the use of a lyocell fiber for the manufacture of a nonwoven fiber fleece according to claim 1.

Preferred embodiments of the invention are set out in the dependent claims.

Furthermore, the object stated above is solved by way of a nonwoven fiber fleece according to claim 6.

Again, preferred embodiments are set out in the dependent claims.

BRIEF DESCRIPTION OF THE DRAWINGS

Preferred embodiments of the invention are described in the following with reference to the drawings.

FIG. 1 a schematic drawing depicting the cross section of a lyocell fiber for use in manufacturing a nonwoven fiber fleece with a cross-sectional aspect ratio according to the invention, FIG. 2 a schematic drawing of the cross section of a nonwoven fiber fleece according to the present invention, FIG. 3*a* an SEM micrograph of a nonwoven fiber fleece in top view according to a first embodiment of the invention, FIG. 3*b* schematic drawing of the top view in FIG. 3*a* with traced contours, FIG. 4*a* an SEM micrograph of the nonwoven fiber fleece shown in FIG. 3 in cross-sectional view, FIG. 4*b* schematic drawing of the cross-sectional view in FIG. 4*a* with traced contours, FIG. 5*a* an SEM micrograph of a comparative nonwoven fiber fleece in top view from standard round lyocell fibers, FIG. 5*b* schematic drawing of the top view in FIG. 5*a* with traced contours, FIG. 6*a* an SEM micrograph of the nonwoven fiber fleece shown in FIG. 5 in cross-sectional view, and FIG. 6*b* schematic drawing of the cross-sectional view in FIG. 6*a* with traced contours.

DETAILED DESCRIPTION OF THE INVENTION

Figure 1:
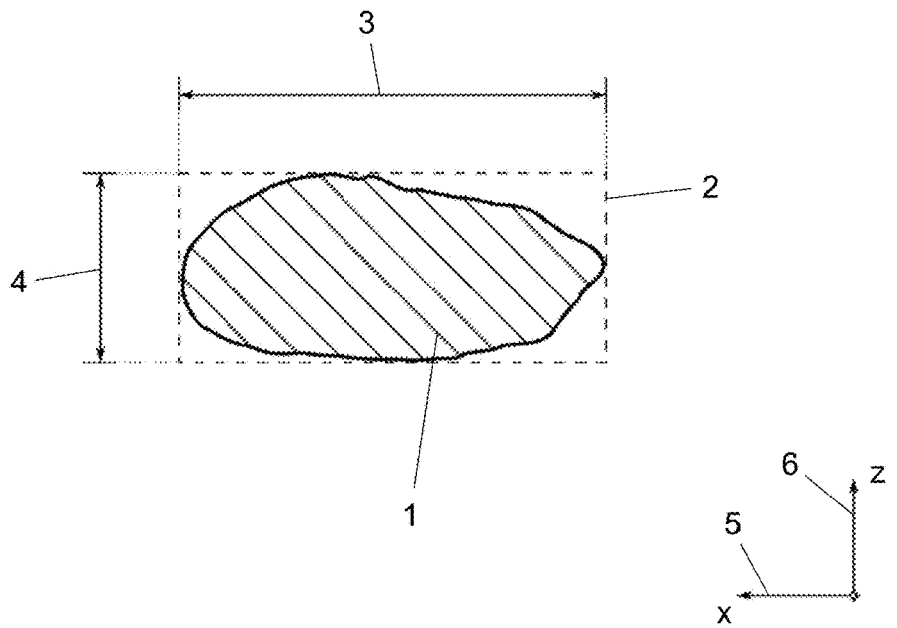
FIGS. 1 to 6 show.

The invention relates to a lyocell fiber for use in the manufacture of a nonwoven fiber fleece, whereby the lyocell fiber exhibits a cross-sectional aspect ratio of at least 1.8.

The cross-sectional aspect ratio of the fiber is defined as the width to height ratio of a minimum bounding rectangle around the cross section of the fiber. The minimum bounding rectangle is the smallest rectangle circumscribing the perimeter of the fiber cross section. The width of the bounding rectangle thereby is measured along the longer direction of the fiber cross section.

In a further preferred embodiment, the lyocell fiber exhibits a cross-sectional aspect ratio from 2 to 10.

It has surprisingly been found that such lyocell fibers with a modified cross section, thus with a cross-sectional aspect ratio as defined above, produced under equivalent process parameters and with the same titer, compared to standard round lyocell fibers, require less energy and time to be refined to an equivalent level. This saves both time and operational costs. Thus, a more efficient manufacturing process may be obtained by using said fibers.

The lyocell fibers with modified cross-sectional aspect ratio retain an unfibrillated solid core after refining, which exhibit an essentially oval cross section. The fibrillated lyocell fibers further comprise thin fibrils protruding from said solid cores.

In preferred embodiments the solid cores of the fibrillated lyocell fibers exhibit a cross-sectional aspect ratio k as defined further below of at least 1.5.

The fibrils protruding from the solid cores may exhibit a width-distribution from approximately 100 nm to approximately 10 μm.

Furthermore, it has surprisingly been found that when converting such fibrillated fibers to a nonwoven fiber fleece, the fibers were aligned within the formed fiber fleece such that the thinner axis of the fibers was perpendicular to the plane of the sheet. This enables the production of a very thin nonwoven fiber fleece still having sufficient tensile properties, such as strength.

The term "lyocell" fiber, as is well known to the skilled artisan, denotes a man-made cellulosic fiber spun from a solution of non-derivatized cellulose in an organic solvent.

The most common type of lyocell fibers nowadays, and an especially preferred embodiment of the present invention, is a lyocell fiber spun according to the amine-oxide process. It is well understood that an amine oxide process includes at least the steps of: (1) dissolving cellulose in an amine oxide solvent, preferably at elevated temperature, to create a solution; (2) spinning the solution (preferably at about 100° C.) and drawing the shaped solution over an air gap; and (3) adding the shaped solution to a spinning bath and precipitating the cellulose.

The amine oxide solvent is most preferably aqueous N-methyl-morpholine-N-oxide (NMMO).

For the purposes of the present invention, the term "nonwoven fiber fleece" denotes any fiber fleece formed by entangling fibers or filaments and bonding them together by means of mechanical, thermal, chemical or hydrogen bonding on a fiber-level. Contrary to that, wovens are formed through a weaving process involving yarns, but are typically not bonded on a fiber-level. The term "nonwoven fiber fleece" includes nonwovens produced by techniques like spunlacing (hydroentanglement), needling or the like. The term "nonwoven fiber fleece" particularly includes papers.

In a preferred embodiment of the present invention, the lyocell fiber is a flat fiber, i.e. has a substantially rectangular cross section.

However, also other lyocell fibers with a modified cross section, thus with a cross section deviating from an essentially round cross section, can be used. Examples for such fibers include multilobal fibers, such as fibers with a "Y" or "X"-shape, or other fibers with non-round cross section, such as fibers with an "8"-shape, provided that the cross-sectional aspect ratio of said fibers fulfils the above provision.

In case of a flat fiber, the lyocell flat fiber may have been produced by spinning a cellulose solution through a die having a rectangular aperture. WO 2010/071906 discloses this way of producing a flat fiber.

Alternatively, the fiber can produced by a process as disclosed in WO 2007/143761 by extruding the solution through a spinneret having several round apertures being located adjacent to each other, so that the filaments extruded through these apertures fuse and form a cross section which, e.g., is essentially rectangular.

The fiber used in the present invention preferably exhibits a titer of from 0.5 dtex to 10 dtex, preferably more than 1 dtex.

It has been found that especially in the case of flat fibers, fibers having a higher titer than a standard lyocell fiber with round cross section, e.g. with a titer of 1.7 dtex, can be fibrillated and formed into a nonwoven fiber fleece, the resulting nonwoven fiber fleece having a thickness lower than that of a sheet formed from said standard lyocell fiber with round cross section. This is because of the surprising discovery that the fibers align themselves horizontally, i.e. with their thinner axis being perpendicular to the plane of the sheet.

As mentioned above, lyocell fibers used according to the invention surprisingly require less energy and time to be refined to an equivalent fibrillation level. This saves both time and operational costs.

The objective of refining is to fibrillate the fiber whilst minimizing the side effect of shortening the fiber lengths. Longer refining times/higher refining energy lead to increased shortening of the fiber length, which in turn lead to poorer mechanical properties of the resulting nonwoven fiber fleece. It is therefore desirable to utilize less refining energy and still achieve the desired level of fibrillation.

It was found that a lyocell fiber with a cross-sectional aspect ratio according to the invention has a better fibrillation tendency than a comparable round standard lyocell fiber. Thus, apparently, the residual fiber lengths of the flat fiber are not as compromised (reduced) compared to round fibers during refining to the same degree of freeness. Therefore nonwoven fiber fleeces made solely out of flat fibers show much better mechanical properties than sheets made of a comparable fibrillated round fiber.

The tenacity, the tearing strength and the burst strength of the nonwoven fiber fleeces made out of fibers according to the invention are increased compared to a nonwoven fiber fleece made out of round standard fibers. In some embodiments, the tenacity may be increased by at least 50%, the tearing strength may be increased by at least 100% and the burst strength may be increased by at least 130%.

The present invention furthermore relates to a nonwoven fiber fleece comprising lyocell fibers, with the nonwoven fiber fleece comprising at least two layers of fibrillated lyocell fibers, with the fibrillated lyocell fibers having solid cores and fibrils protruding from said cores, the fibers and fibrils being intermingled to form the fiber fleece, embedding the solid cores therein, whereby the solid cores of the fibrillated lyocell fibers have an average cross-sectional aspect ratio k of at least 1.5.

In a further preferred embodiment, the solid cores of the fibrillated lyocell fibers have an average cross-sectional aspect ratio k of at least 1.8, preferably of at least 2.0, more preferably of at least 2.2.

The average cross-sectional aspect ratio k of the solid cores of the fibrillated lyocell fibers is defined as $$k = b/h$$

(1) where b is the mean visible width of solid cores in microscopic top view of the fiber fleece and h is the mean visible height of solid cores in microscopic cross-sectional view of the fiber fleece.

By taking a cross-sectional cut of a fiber fleece, the solid cores of the fibers are cut in different angles, thus, the width of the solid cores (perpendicular to the fiber longitudinal axis) cannot be determined reliably from a cross-sectional view. Hence, the determination of the average cross-sectional aspect ratio k needs to be split into the independent determination of the mean visible width b and the mean visible height h of the solid cores.

The mean visible width b of solid cores may safely be determined by taking a top view of a fiber fleece (e.g. by means of SEM micrographs) and obtaining several width-measurements of visible solid cores perpendicular to the direction of elongation of the fibers and calculating the average value thereof. The measurements are taken at positions with essentially consistent width of the solid cores, i.e. not at the strongly fibrillated regions of the fibrillated fibers.

The mean visible height h of solid cores may on the other hand be determined by taking a cross-sectional view of the fiber fleece (e.g. by means of SEM micrographs). Due to the varying directions of elongation of the solid cores in the fiber fleece, the solid cores are cut in different angles and hence the cross sections of the solid cores may appear altered or even "smeared out". Thus, to obtain reliable and representative measurements of the height of the solid cores, height-measurements are taken of several distinctive, clearly discernible solid cores only and the average value is calculated thereof. Care has to be taken, to not obtain measurements at the strongly fibrillated regions of the fibers.

The average cross-sectional aspect ratio k thus represents the ratio between the mean width of the solid cores and the mean height of the solid cores, determined in positions of substantially consistent width and height of the solid cores. This measure in turn correlates to the cross-sectional aspect ratio of the (unfibrillated) lyocell fibers according to the invention, determined from the minimum bounding rectangle circumscribing the perimeter of the lyocell fiber cross section.

Due to the fibrillation of the lyocell fibers in the refining process, the cross-sectional aspect ratio of the solid cores of the fibrillated lyocell fibers may, however, be altered with regard to the cross-sectional aspect ratio of the lyocell fibers before refining.

If the solid cores exhibit an average cross-sectional aspect ratio k according to the invention, a nonwoven fiber fleece may be obtained, wherein the fibrillated fibers are aligned so that the thinner axis of the solid cores are perpendicular to the plane of the nonwoven fiber fleece. A very thin nonwoven fiber fleece without compromising its mechanical strength and tensile properties may thus be obtained.

Preferably, the nonwoven fiber fleece may be obtained from processes for manufacturing fiber fleeces using lyocell fibers as defined above.

In yet another embodiment, the nonwoven fiber fleece is a paper.

The thickness of the nonwoven fiber fleece may be preferably 20 μm or less, more preferably 10 μm or less.

In a further preferred embodiment, the nonwoven fiber fleece essentially consists of the lyocell fibers.

In another embodiment, the nonwoven fiber fleece may consist of blends including the lyocell fibers. The skilled artisan can thereby include other suitable fibers into the nonwoven fiber fleece, as long as the claimed effect is achieved. Such other fibers may be for example include natural cellulose fibers such as woodpulp, hemp, sisal, flax, abaca, kenaf, Esparto, etc., synthetic polymers such as polyester, polyamide, polyvinylalcohol, polyolefin, aramid, etc., or inorganic fibers, such as glass fibers, etc.

In a further embodiment, the solid cores of the fibrillated lyocell fibers exhibit a mean height of 10 μm or less, more particularly of 7 μm or less, preferably of 4.5 μm or less. Due to the maximum height of the solid cores of the flat fibers, a very thin nonwoven fiber fleece can be achieved, which is suitable as battery separator.

In an even further embodiment, the solid cores of the fibrillated lyocell fibers exhibit a mean width of at least 15 μm, more particularly of between 20 and 40 μm.

For example, if a lyocell flat fiber with a titer of about 2.7 dtex and a cross-sectional aspect ratio of about 4 is used for the manufacture of the fiber fleece, the solid cores of the fibrillated lyocell fibers exhibit mean heights in the range of 5-8 μm and mean widths in the range of 15-30 μm.

Where lyocell flat fibers with titers other than 2.7 dtex are used, the mean widths and heights of the solid cores will vary accordingly, depending on the cross-sectional aspect ratio of the lyocell flat fibers according to the invention.

In another aspect, the present invention provides a method for manufacturing a nonwoven fiber fleece comprising lyocell fibers, comprising the steps of

- providing a lyocell fiber having a cross-sectional aspect ratio of at least 1.8, preferably from 2 to 10
- refining the lyocell fiber to form fibrillated lyocell fibers
- forming the nonwoven fiber fleece by entangling at least the fibrillated lyocell fibers and bonding them together on a fiber-level In a further aspect of the invention, the fibrillated lyocell fibers after refining comprise solid cores and fibrils protruding from said cores. After refining, the solid cores of the fibrillated lyocell fibers preferably have an average cross-sectional aspect ratio k of at least 1.5.

In an even further aspect of the invention, bonding of the fibrillated lyocell fibers on a fiber-level involves intermingling of the fibers and fibrils to form the fiber fleece, embedding the solid cores therein.

For all aspects of the method for manufacturing a nonwoven fiber fleece, the discussion of preferred embodiments described above and below apply equally.

In the following, preferred embodiments of the invention are described with reference to the figures.

FIG. 1 depicts a schematic drawing of a lyocell fiber 1 for use in manufacturing a nonwoven fiber fleece. The lyocell fiber 1 exhibits an essentially non-round shape and can be circumscribed by a minimum bounding rectangle 2, which represents the smallest rectangle circumscribing the perimeter of the fiber cross section.

The cross-sectional aspect ratio of the fiber 1 can be obtained by dividing the width 3 of the minimum bounding rectangle 2 by the height 4 of the minimum bounding rectangle 2. The width 3 of the fiber 1 is measured along the longer direction 5 of the fiber cross section, while the height 4 of the fiber 1 is measured along the short direction 6 of the fiber cross section. For fiber 1 schematically depicted in FIG. 1, the cross-sectional aspect ratio amounts to 2.26.

For the sake of simplicity, it is assumed that the fiber 1 extends along the y-axis, while the long direction 5 of the fiber cross section coincides with the x-axis and the short direction 6 of the fiber cross section coincides with the z-axis.

Due to the modified (flat) cross section, the fiber 1 requires much less energy and time to be refined to an equivalent (freeness) level than standard round fibers. Thus, a more cost-efficient manufacturing of nonwoven fiber fleeces may be obtained.

Figure 2:
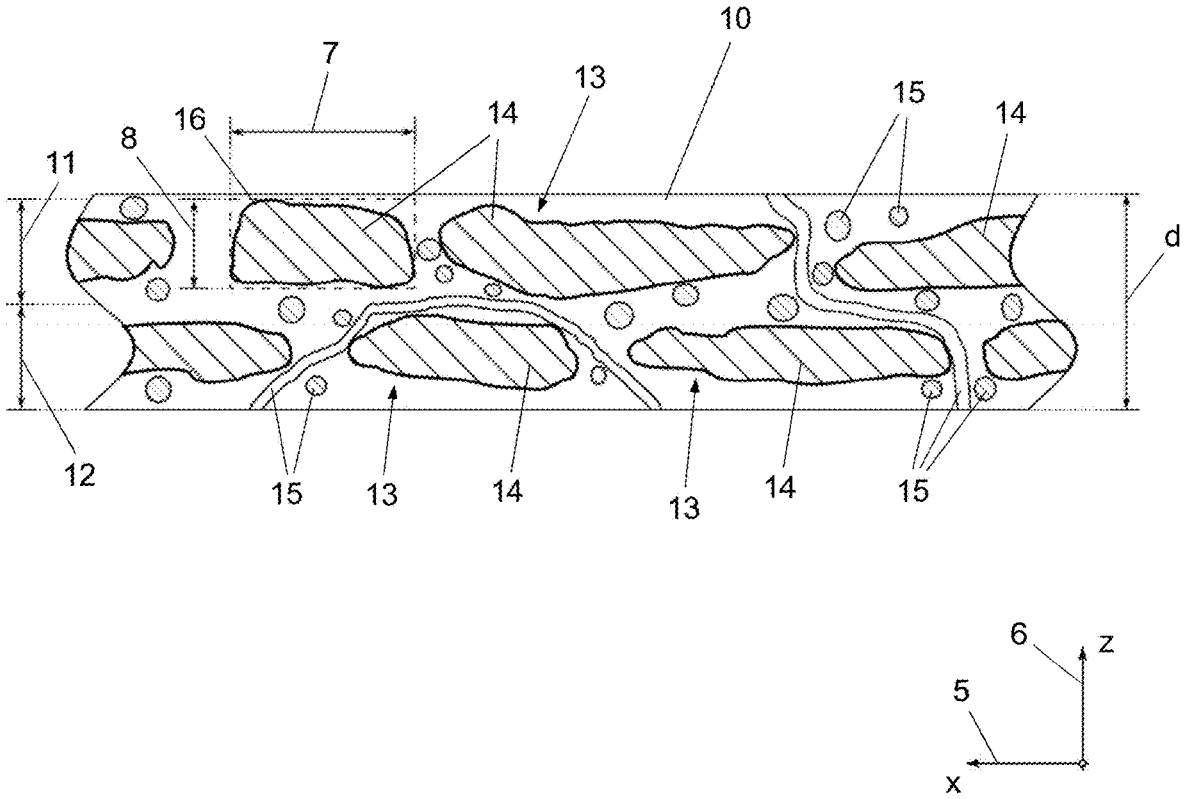

Such nonwoven fiber fleece 10 is schematically depicted in FIG. 2. The nonwoven fiber fleece 10 comprises layers 11, 12 consisting of fibrillated lyocell fibers 13. The fibrillated lyocell fibers 13 thereby consist of solid cores 14 and fibrils 15 protruding from said solid cores 14.

According to the simplified schematic drawing in FIG. 2, the fibers 13 are mainly oriented, i.e. extend, along the y-axis, while the nonwoven fiber fleece 10 extends in the x/y-plane. However, in other embodiments, the fibrillated lyocell fibers 13 may be oriented along any direction in the x/y-plane, thus, overlapping randomly.

The layers 11, 12 and thus the whole nonwoven fiber fleece 10 are/is formed through the intermingled fibrils 15, whereby the solid cores 14 are embedded in the dense network of intermingled fibrils 15 forming the fiber fleece 10.

The average cross-sectional aspect ratio k of the nonwoven fibers within fleece 10, defined through formula (1) as the ratio between mean visible width b and the mean height h of the solid cores 14, thereby amounts to at least 1.5. The solid cores 14 may be equally circumscribed by a minimum bounding rectangle 16, which represents the cross-sectional aspect ratio k. The visible width 7 can preferably be determined from a top view of the fiber fleece 10 and measurements should be taken at different positions of different solid cores 14 to calculate the mean visible width b thereof. The determination of the visible widths 120 of solid cores 110 is demonstrated in FIGS. 3*a* and 3*b* for a fiber fleece 100 according to example 1 as described in the examples section below. It is less preferable to determine the widths 7 from a cross-sectional view as schematically depicted in FIG. 2, as such cross-sectional view may over-estimate the widths 7 due to non-perpendicular cuts of the fibers 13. The heights 8 of the solid cores 14 on the other hand can be determined from a cross-sectional view of the fiber fleece 10, whereby the mean height h should be calculated of measurements from several solid cores 14. Such determination of heights 130 of solid cores 110 from a cross-sectional view is demonstrated in FIGS. 4*a* and 4*b* for the fiber fleece 100 according to example 1.

It is preferable to determine the mean visible width b and the mean height h from taking width 7 and height 8 measurements of at least 5 (five) solid cores 14, more preferable of at least 8 (eight) solid cores 14, respectively. The top view for determining the widths 7 of the solid cores 14 preferably covers a surface area of at least 0.2 $mm^2$, more preferably of at least 0.4 $mm^2$, of the fiber fleece 10. The cross-sectional view for determining the heights 8 of the solid cores 14 preferably covers a distance along the cross-section of at least 150 μm, more preferably of at least 200 μm, of the fiber fleece 10.

In a preferred embodiment, the average cross-sectional aspect ratio k of the nonwoven fiber fleece amounts to at least 2.0.

The fibers 13 predominantly align with their short direction of the cross section along the z-axis 6, thus, the vast majority of the fibers 13 lie essentially flat in the x/y-plane. The nonwoven fiber fleece 10 thus has a thickness d lower than that of a nonwoven fiber fleece formed from standard lyocell fibers which have a round cross section. A much thinner fiber fleece 10 may thereby be obtained.

Other embodiments of the present invention, which are not depicted in the figures, may be executed within the scope of the claims. The figures and embodiments presented above do not limit the scope of protection.

EXAMPLES

In the following, the advantages according to the invention are demonstrated using inventive and comparative examples. It is noted, however, that the examples presented below are only illustrative and do not limit the scope of the invention.

Thereby, the lyocell fibers with a cross-sectional aspect ratio according to the invention have been produced by the production method as described in the following.

Fiber Production

A cellulose pulp was mixed with an amine oxide/water solvent to produce a lyocell spinning dope. Under vacuum water was evaporated until dissolution of the pulp occurs. After dissolution, the pulp concentration in the dope was 13%. The resulting spinning dope was filtered and transported to a spinning pump.

The dope was extruded by a spinning pump through a spinneret with modified extrusion orifices at 115° C. and at a rate of 0.05 g/min per hole in order to produce the cross-sectional modified fibers. The fibers were extruded from the spinneret into an air gap of approx. 30 mm height. In said air gap, the fibers were then conditioned with a cross draught at ~20° C., having 8.6 g $H_2O$/kg dry air and a linear velocity of 4.2 m/s.

Finally, the fibers were coagulated in a spin bath containing a 25% amine oxide solution and then transported to further finishing steps via rollers. Thereby, the fibers were produced at a speed of ~30 m/min to achieve the desired titer of 2.7 dtex. At suitable intervals the produced fiber cable was cut and washed in demineralized water to remove all traces of amine oxide on the fiber and obtain tows thereof.

The tows were produced accordingly over two days of trials, labelled and stored in plastic bags to be handed over for the application of soft finish.

For applying the soft finish, the tow was removed from its plastic bag and the remaining water pressed off using a Foulard at 5 bar. The soft finish was prepared and the tow immersed in an aqueous finish solution, such that a finish application level of 0.2% (weight on fiber) was achieved. The finished tow was then dried for 48 h in a drying cabinet at 65° C., after which it was handed over for cutting.

For cutting, the dried and finished tow was cut using a leaf guillotine into 5 mm lengths. The cut cross-sectional modified fibers were stored in clear plastic bags and handed over to refining.

Refining

Within refining, the cut, finished and dried cross-sectional modified fibers were refined in a single disc refiner having a plate distance of 0.35 mm and a concentration of 0.6%, in order to fibrillate the fibers. Thereby, the fibers were refined to SR 80° freeness. The dry content after refining and dewatering amounted to approx. 20%. Finally, 500 g of the refined fiber were stored in a plastic bag and were kept refrigerated at 4° C. until producing the nonwoven fiber fleeces.

Nonwoven Fiber Fleece Production

For the production of the nonwoven fiber fleeces according to the invention, 100% of refined cross-sectional modified fibers, obtained according to the method described above, were used. The dry content of the fibers was measured to be 18.74% before production. After determining the dry content, the amount of fibers needed for the production of a 30 gsm nonwoven fiber fleece was determined and weighed. The weighed fibers were dispersed in a mixer with 1 l of water at 3000 rpm for 45 s. The resulting suspension was then transferred to a disperser where the suspension was further diluted with 2 l of water and sparged for 10 s with gas. Immediately after sparging the water was drained off so that a nonwoven fiber fleece was formed on top of a filter. A foil of approx. 1 mm thickness was placed on the resulting fiber fleece to create a filter, fleece and foil stack, which was then dried in a vacuum at 92° C. for 10 min. Thereafter, the foil was removed and the fiber fleece taken off of the filter. The fiber fleece was stored in a transparent sheath until further analysis.

Measurement Methods

For obtaining SEM (scanning electron microscopy) micrographs, an approx. 1 $cm^2$ sized sample was cut out of the middle of the nonwoven fiber fleece manufactured according to the method described above. The cut sample was sprayed with Au for 120 s. For measurements, a FEI Quanta 450 scanning electron microscope was operated at 5 kV with the following settings: Spot 3, HV, EDT, WD10.

Breaking force and elongation of samples were measured according to DIN EN ISO 1924-2 of 2009. Prior to measurements, samples of 50 mm×100 mm were stamped out of the middle of the nonwoven fiber fleece and conditioned for 24 h at 23° C. and 50% humidity. The measurements were taken with a ZWICK ROELL Z2.5 material tester, using the following settings: load cell: 200 N, clamp gap: 80 mm, 20 mm/min traverse speed. Measurements were obtained as average values out of 10 samples.

Tearing strength was measured according to NWSP 100.2.R1 (15). Samples of 75 mm×150 mm were stamped out of the middle of the nonwoven fiber fleece and conditioned for 24 h at 23° C. and 50% humidity. Measurements were again conducted with a ZWICK ROELL Z2.5 material tester, using the following settings: load cell: 200 N, clamp gap: 25 mm, 100 mm/min traverse speed, stopped when 40 mm traverse length was reached. Measurements were obtained as average values out of 5 samples.

Burst strength was measured according to WSP 110.5 (05). Thereby, samples of 100 mm×100 mm were stamped out of the middle of the nonwoven fiber fleece and conditioned for 24 h at 23° C. and 50% humidity. The sample was fixed on the bottom of a ZWICK ROELL Z2.5 material tester, and an opposite ball was moved to the paper surface until a minimum force of 0.25 N was measured. Then, the ball was moved slightly back until a force of 0 N was measured. The ball stamp then moved with 300 mm/min through the sample. Measurements were obtained as average values out of 5 samples.

Results and Discussion

Nonwoven fiber fleece (paper) sheets were manufactured on small scale comprising flat cross-sectional lyocell fibers according to the production method described above. Microscopic examination by SEM showed, that the fibers were aligned within the sheet such that the direction of their thinner cross-sectional axis was perpendicular to the plane of the sheet, thus aligned along the z-axis as schematically depicted in FIG. 2.

The flat cross-sectional lyocell fibers retained an unfibrillated core after refining, which exhibited an essentially non-round cross section. The widths of the residual cores of fibrillated flat cross-sectional lyocell fibers were measured and their thickness along the thinner axis (z-axis) was determined. Fibers initially spun with an average linear density (titer) of approximately 2.7 dtex and a cross-sectional aspect ratio of about 3.6 exhibited z-axis thicknesses of approximately 7 to 7.7 μm. After refining to 80° SR, the z-axis thicknesses of the residual cores were reduced and ranged between approximately 3 and 7 μm. When used to form paper sheets, the minimum attainable sheet thickness is proportional to the z-axis thickness of the flat cross-sectional fibers.

It therefore follows, that despite its high titer, the fibrillated flat fiber can still be used to produce a suitably thin separator paper. Depending on spinnerets employed and process parameters used, varying geometries, as well as smaller titers can be produced. These would in turn further decrease the residual thickness and enable the production of even thinner sheets. The limiting factor is expected then to be the desired mechanical properties of the produced sheet, which in turn are improved when using flat fibers instead of standard round fibers.

Due to their improved mechanical properties, flat fibers can be used to produce a remarkably stable but thin sheet with a thickness of less than 10 μm.

Example 1

An exemplary nonwoven fiber fleece 100 according to the invention (example 1) was produced according to the production method described above, using 2.7 dtex lyocell fibers with an average cross-sectional aspect ratio of 3.57, a mean width of 26.21 μm and a mean height of 7.34 μm. The fiber widths and heights were investigated by means of cross-sectional SEM micrographs of several randomly selected samples. Among these samples, no individual (unfibrillated) fiber with a cross-sectional aspect ratio of less than 3 was found.

Figure 3A:
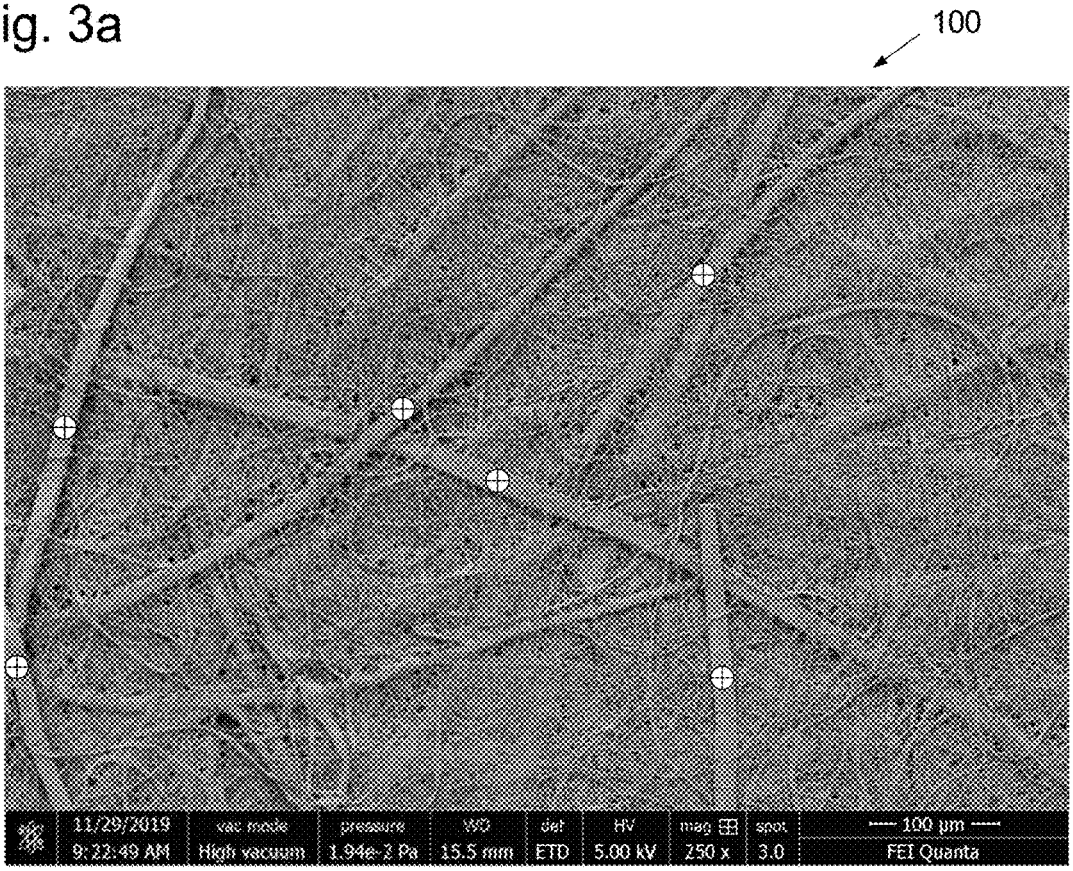
Figure 3B:
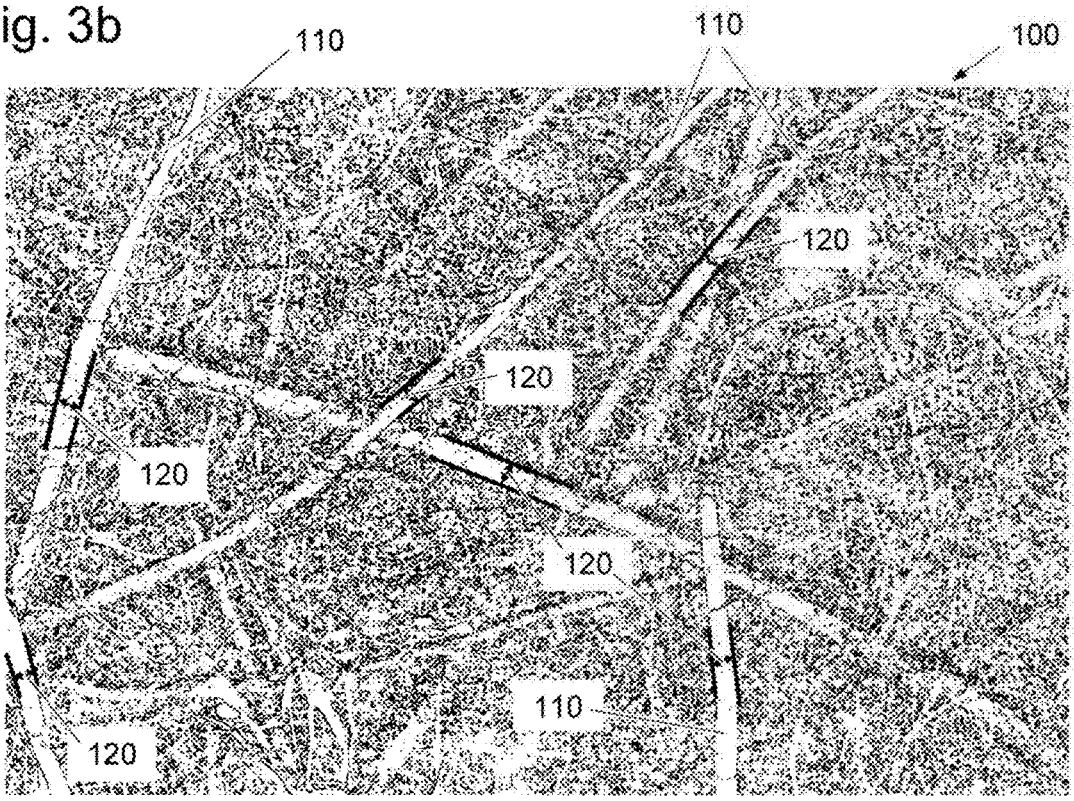
Figure 4A:
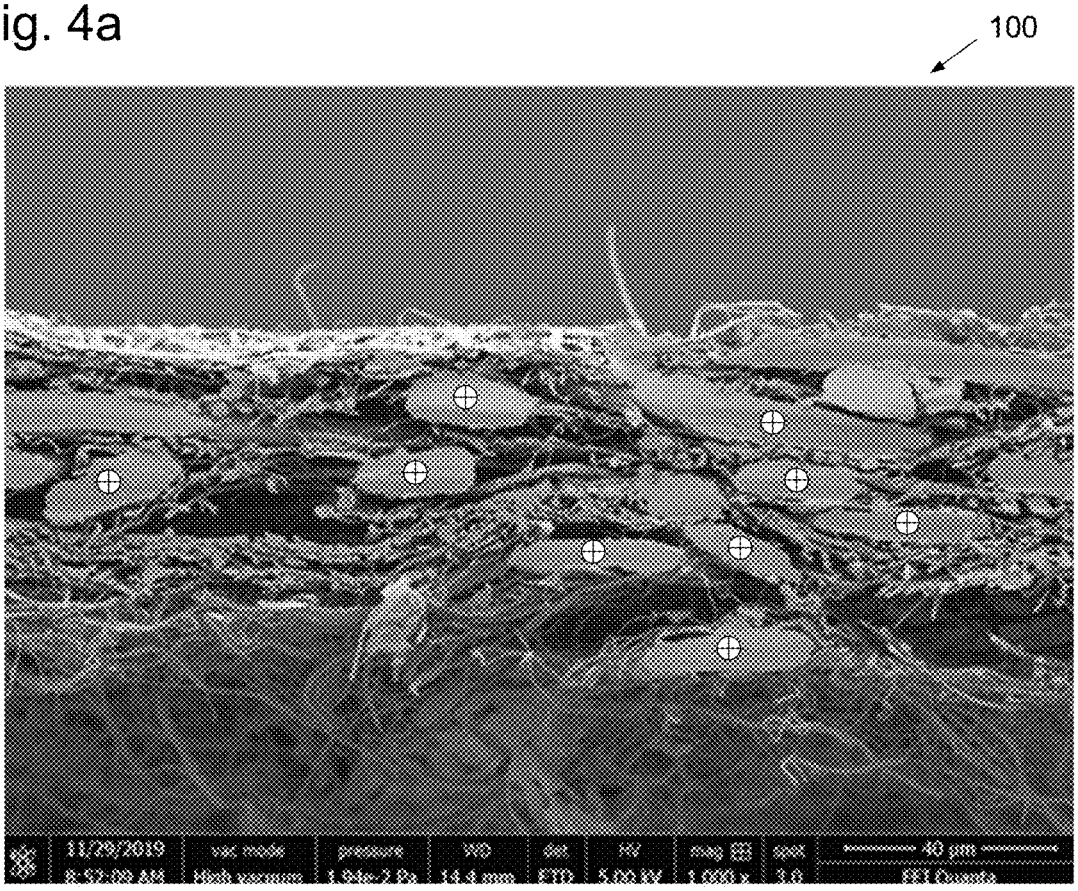
Figure 4B:
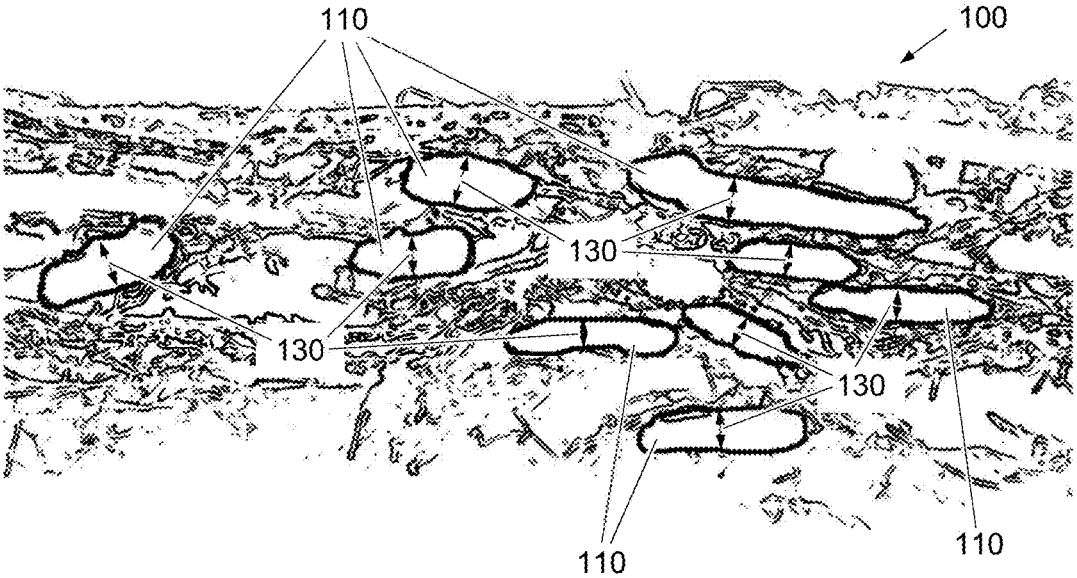

In FIGS. 3*a* and 4*a* SEM micrographs of the manufactured nonwoven fiber fleece 100 of example 1 are shown. FIG. 3*a* depicts a top view and FIG. 4*a* a cross-sectional view of the fiber fleece 100. FIGS. 3*b* and 4*b* show traced contours of the SEM micrographs depicted in FIGS. 3*a* and 4*a*, respectively.

In the top view of FIG. 3*a*, several solid cores 110 of the fiber fleece 100 can be discerned. As depicted in FIG. 3*b*, a number of distinctive sections of said solid cores 110, which exhibit a substantially consistent width and are not situated at the strongly fibrillated regions of the fibers, were selected and visible widths 120 were determined thereof. The selected sections of solid cores 110 are marked in FIG. 3*a* by crosshairs. The width-measurements of the six selected sections are recited in Table 1.

Also in the cross-sectional SEM micrograph shown in FIG. 4*a*, a number of solid cores 110, embedded in a network of fibrills, can be discerned. As schematically shown in FIG. 4*b*, four distinctive solid cores 110 were selected for the determination of the visible heights 130 of the solid cores. Thereby, only clearly discernible solid cores 110 which were cut at an angle close to 90° and which show no signs of strong fibrillation, were selected. The selected solid cores 110 are again marked in FIG. 4*a* by crosshairs. The height-measurements of said four selected solid cores 110 are listed in Table 2.

TABLE 1

Measurements of widths (120) of selected solid cores (110) in example 1.

| Measurements | 1 | 2 | 3 | 4 | 5 | 6 |
|---|---|---|---|---|---|---|
| Width (120) of solid cores (110) [μm] | 15.15 | 16.36 | 17.57 | 16.96 | 12.12 | 15.15 |

TABLE 2

Measurements of heights (130) of selected solid cores (110) in example 1.

| Measurements | 1 | 2 | 3 | 4 | 5 | 6 | 7 | 8 | 9 |
|---|---|---|---|---|---|---|---|---|---|
| Height (130) of solid cores (110) [μm] | 10.19 | 6.94 | 9.26 | 5.56 | 5.74 | 5.37 | 7.22 | 6.20 | 5.37 |

Calculating the average values of determined widths (120) and heights (130) according to Tables 1 and 2, the inventive nonwoven fiber fleece 100 of example 1 exhibits a mean width b of solid cores of 15.55 μm and a mean height h of solid cores of 6.87 μm. Hence, the average cross-sectional aspect ratio k of the solid cores amounts to 2.26.

In other inventive examples according to the description above, which have not been depicted in the figures, the average cross-sectional aspect ratio k was determined to be 2.24, 1.92 and 2.04, respectively.

Comparative Example 2

A comparative example of a nonwoven fiber fleece 200 was produced from standard round lyocell fibers with a titer of 2.7 dtex, The fleece was produced according to the production method described above. The round lyocell fibers had an average cross-sectional aspect ratio of 1 and a mean diameter of 15.1 μm.

Figure 5A:
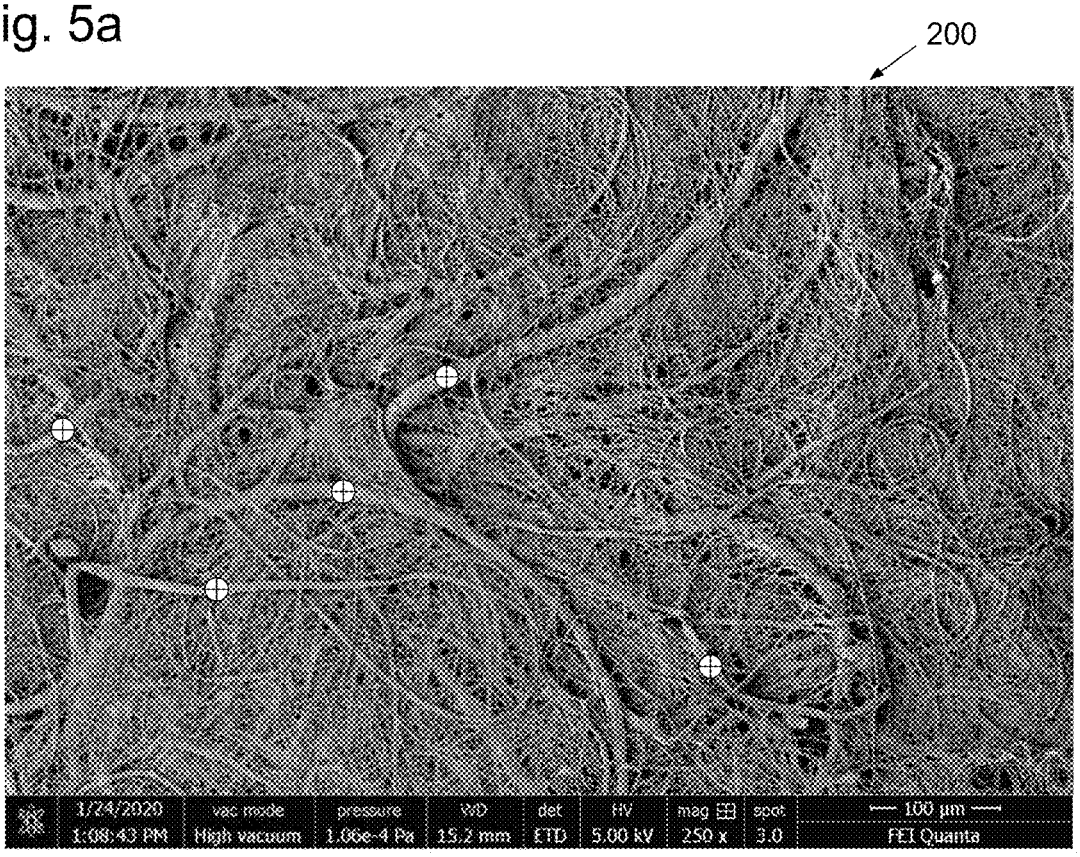
Figure 5B:
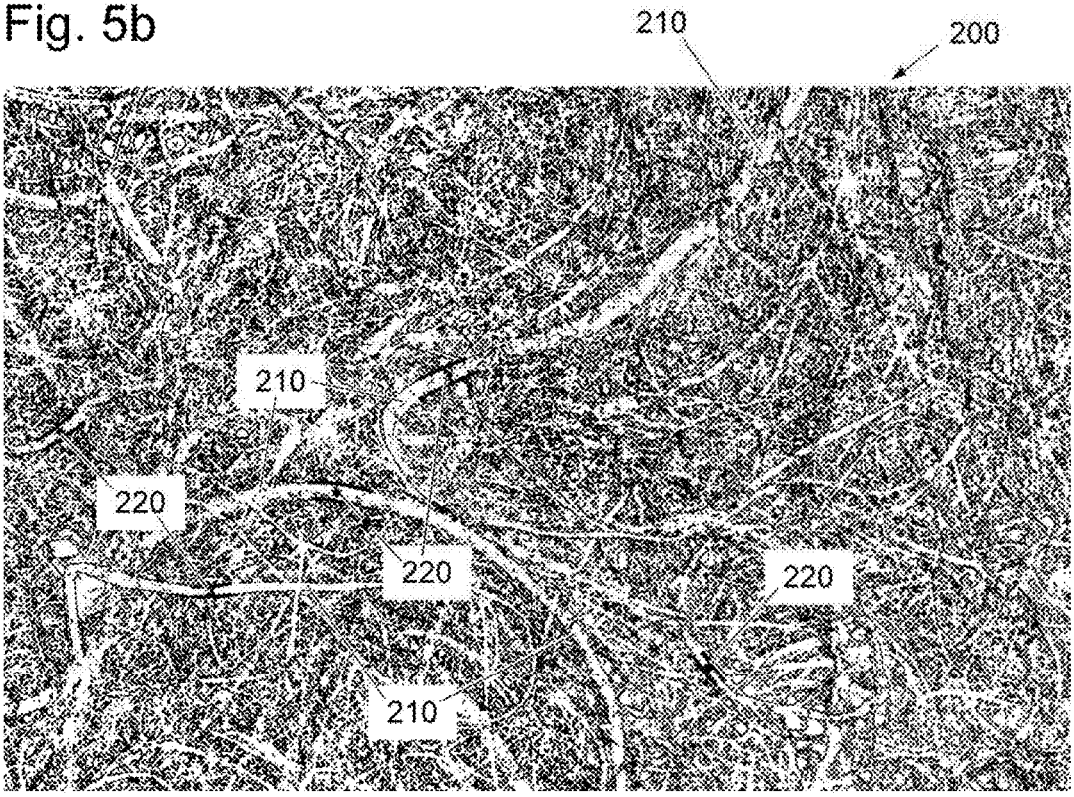
Figure 6A:
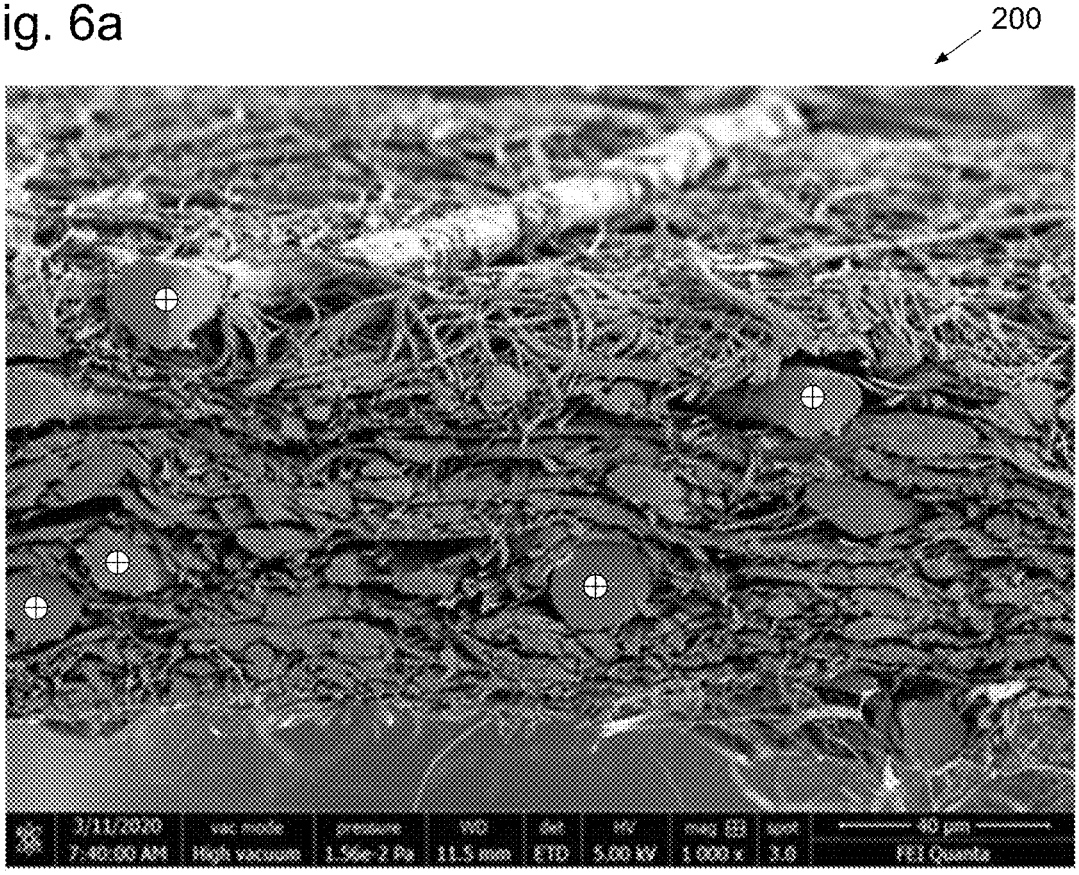
Figure 6B:
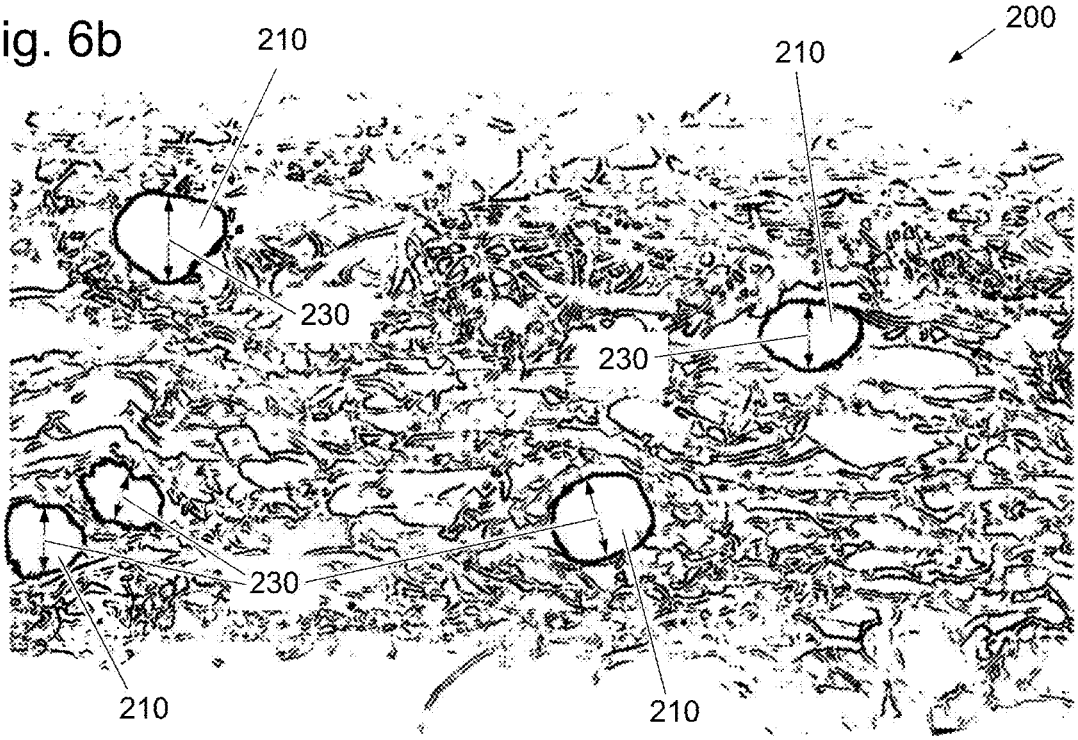

In FIGS. 5 and 6 SEM micrographs of said comparative example 2 are shown. FIG. 5*a* again depicts a top view and FIG. 6*a* displays the cross-sectional view of the fiber fleece 200. FIGS. 5*b* and 6*b* again show traced contours of the SEM micrographs depicted in FIGS. 5*a* and 6*a*, respectively.

From the top view in FIG. 5*a*, several solid cores 210 can be identified in the fiber fleece 200. From said solid cores 210, only those may be selected for determining the average visible width 220, which show at least sections of substantially consistent width with no signs of strong fibrillation. Care has to be taken to not take into consideration fibrils which are protruding from a solid core. As depicted in FIG. 5*b*, four distinctive sections of said solid cores 210 were selected and visible widths 220 were determined thereof. The width-measurements obtained in this way are summarized in Table 3.

From the cross-sectional SEM micrograph shown in FIG. 6*a*, again a number of solid cores 210 can be discerned. FIG. 6*b* depicts the traced contours of the SEM micrograph in FIG. 6*a* and emphasizes five distinctive solid cores 210, which were selected for the determination of the visible heights 230. Again, care should be taken when selecting the solid cores 210 for examination that only clearly discernible solid cores 210 which were cut at angles close to 90° and which show no signs of strong fibrillation, were selected. The height-measurements of the five selected solid cores are listed in Table 4.

TABLE 3

Measurements of widths (220) of selected solid cores (210) in comp. example 2.

| Measurements | 1 | 2 | 3 | 4 | 5 |
|---|---|---|---|---|---|
| Width (220) of solid cores (210) [μm] | 13.51 | 9.45 | 13.51 | 8.11 | 8.11 |

TABLE 4

Measurements of heights (230) of selected solid cores (210) in comp. example 2.

| Measurements | 1 | 2 | 3 | 4 | 5 |
|---|---|---|---|---|---|
| Height (230) of solid cores (210) [μm] | 11.25 | 9.82 | 16.34 | 15.18 | 11.25 |

Calculating the average values of determined widths (220) and heights (230) according to Tables 3 and 4, the nonwoven fiber fleece 200 of comparative example 2 with standard round lyocell fibers exhibits a mean width b of solid cores of 10.54 μm and a mean height h of solid cores of 12.77 μm. Hence, the average cross-sectional aspect ratio k of the solid cores (210) amounts to 0.83.

In other comparative examples with standard round lyocell fibers, which have not been depicted in the figures, the average cross-sectional aspect ratio k was determined to be 0.91, 1.04 and 1.31, respectively.

Table 5 (below) summarizes the parameters and mechanical properties of the nonwoven fiber fleece of example 1, as well as the improvement of said properties compared to the nonwoven fiber fleece of comparative example 2 made from standard round lyocell fibers.

Discussion

Due to refining, the mean width b and height h of the solid cores were reduced with respect to the (unrefined) fiber dimensions for both the flat (inventive) and round (comparative) lyocell fibers from examples 1 and 2. Also the average cross-sectional aspect ratio k of the solid cores of the flat lyocell fiber is reduced to 2.27 with respect to the cross-sectional aspect ratio of the unrefined flat lyocell fiber of 3.57. This reduction will, however, vary depending on the refining process and its parameters and may even vary within a single batch. In other examples (not shown), the cross-sectional aspect ratio has been observed to stay constant or even increase slightly. Such a change in the cross-sectional aspect ratio is expected and is uncritical as long as the average cross-sectional aspect ratio k of the solid cores lies within the ranges stipulated by the claims.

As can be seen from Table 5, by using the cross-sectionally modified flat lyocell fibers for manufacturing a nonwoven fiber fleece, the energy input for refining the fibers may be reduced by 67.5%, while at the same time the tensile properties are remarkably improved with respect to standard round lyocell fibers.

TABLE 5 parameters and properties of example 1 and comparative example 2.

| Example | Example 1 | Comparative example 2 | Improvement over Comparative example 2 |
|---|---|---|---|
| Properties of the fibers prior to refining | | | |
| Titer [dtex] | 2.7 | 2.7 | |
| Fiber type | lyocell (flat) | lyocell (round) | |
| Mean fiber width [μm] | 26.21 | 15.1 | |
| Mean fiber height [μm] | 7.34 | 15.1 | |
| Average cross-sectional aspect ratio of the fibers | 3.57 | 1 | |
| Energy input for refining [kWh] | 11.2 | 34.4 | −67.5% |
| Properties of the manufactured fiber fleece | | | |
| Basis weight [g/m$^2$] | 34 | 28 | |
| Mean visible width b of solid cores [μm] | 15.55 | 10.54 | |
| Mean visible height h of solid cores [μm] | 6.87 | 12.77 | |
| Average cross-sectional aspect ratio k | 2.27 | 0.83 | |
| Thickness of the fiber fleece [μm] | 110 | 110 | |
| Tensile strength [N/50 mm] | 35.8 | 23.4 | +52.9% |
| Tearing strength [N/75 mm] | 4.55 | 2.23 | +103.7% |
| Burst strength [N] | 46.8 | 19.9 | +135.2% |

The invention claimed is:

1. A nonwoven fiber fleece comprising at least two layers of fibrillated lyocell fibers, with the fibrillated lyocell fibers having solid cores and fibrils protruding from the solid cores, the fibrillated lyocell fibers and fibrils being intermingled to form the nonwoven fiber fleece, wherein the solid cores are embedded in the nonwoven fiber fleece, whereby the solid cores of the fibrillated lyocell fibers have an average cross-sectional aspect ratio k of at least 1.5, wherein the average cross-sectional aspect ratio k is defined by k=b/h, where b is a mean visible width of the solid cores from a microscopic top view of the fiber fleece and h is a mean visible height of the solid cores from a microscopic cross-sectional view of the fiber fleece.

2. The nonwoven fiber fleece according to claim 1, wherein the average cross-sectional aspect ratio k is at least 1.8.

3. The nonwoven fiber fleece according to claim 1, wherein the nonwoven fiber fleece is a paper.

4. The nonwoven fiber fleece according to claim 1, wherein the nonwoven fiber fleece exhibits a thickness d of 20 μm or less.

5. The nonwoven fiber fleece according to claim 1, wherein the nonwoven fiber fleece comprises at least 20 wt.-% lyocell fibers in dry mass.

6. The nonwoven fiber fleece according to claim 1, wherein the nonwoven fiber fleece consists of lyocell fibers.

7. The nonwoven fiber fleece according to claim 1, wherein the nonwoven fiber fleece consists of a fiber blend comprising lyocell fibers and other fibers, with the other fibers being selected from the group consisting of natural cellulose fibers, synthetic polymer fibers and inorganic fibers.

8. The nonwoven fiber fleece according to claim 1, wherein the solid cores have a mean height of 10 μm or less.

9. A battery separator paper, comprising the nonwoven fiber fleece according to claim 1.

10. The nonwoven fiber fleece according to claim 2, wherein the average cross-sectional aspect ratio k is at least 2.0.

11. The nonwoven fiber fleece according to claim 4, wherein the nonwoven fiber fleece exhibits a thickness d of 10 μm or less.

12. The nonwoven fiber fleece according to claim 8, wherein the solid cores have a mean height of 7 μm or less.

13. The nonwoven fiber fleece according to claim 12, wherein the solid cores have a mean height of 4.5 μm or less.

* * * * *